US007328953B2

(12) United States Patent
Werschmidt

(10) Patent No.: US 7,328,953 B2
(45) Date of Patent: Feb. 12, 2008

(54) CUSTOMIZED ARTICULATING ANATOMICAL SUPPORT

(75) Inventor: Gary Werschmidt, Yorba Linda, CA (US)

(73) Assignee: Columbia Medical Manufacturing, LLC, Santa Fe Springs, CA (US)

( * ) Notice: Subject to any disclaimer, the term of this patent is extended or adjusted under 35 U.S.C. 154(b) by 509 days.

(21) Appl. No.: 10/661,377

(22) Filed: Sep. 12, 2003

(65) Prior Publication Data

US 2005/0057083 A1 Mar. 17, 2005

(51) Int. Cl.
*A47C 1/022* (2006.01)

(52) U.S. Cl. ..... 297/354.13; 297/51; 297/440.24; 297/34

(58) Field of Classification Search ..... 297/354.13, 297/423.37, 449.1, 900, 440.15, 440.21, 297/440.22, 440.24, 19, 29, 31, 34–35, 45, 297/51–54, 218.1
See application file for complete search history.

(56) References Cited

U.S. PATENT DOCUMENTS

| | | | | |
|---|---|---|---|---|
| 131,419 | A | 9/1872 | Black | |
| 364,053 | A | 5/1887 | Skau | |
| 469,569 | A | 2/1892 | Hogan | |
| 1,188,534 | A | 6/1916 | Corwin | |
| 1,190,523 | A | 7/1916 | Dodd | |
| 1,386,612 | A | 9/1921 | Farah | |
| 2,040,942 | A | 5/1936 | Katenkamp | |
| 2,740,465 | A * | 4/1956 | Mugler | 297/31 |
| 2,911,245 | A | 11/1959 | Kurz | |
| 3,123,398 | A | 3/1964 | Murcott | |
| 3,290,090 | A | 12/1966 | Ford | |
| 3,352,580 | A | 11/1967 | Kurz et al. | |
| 3,832,740 | A | 9/1974 | McClarrin | |
| 3,835,483 | A | 9/1974 | Emery et al. | |
| 3,840,268 | A | 10/1974 | Johndrow et al. | |
| 3,918,822 | A | 11/1975 | Rauschenberger | |
| 3,994,030 | A | 11/1976 | Cassell et al. | |
| 4,058,341 | A | 11/1977 | Prins | |
| 4,140,065 | A | 2/1979 | Chacon | |
| 4,150,445 | A | 4/1979 | Bailey | |
| 4,166,297 | A | 9/1979 | Saleeby | |
| 4,266,306 | A | 5/1981 | Lee | |
| 4,295,683 | A | 10/1981 | Dubbink et al. | |
| 4,354,710 | A | 10/1982 | Rauschenberger | |
| 4,391,006 | A | 7/1983 | Smith | |
| 4,472,844 | A | 9/1984 | Mace | |
| 4,508,384 | A * | 4/1985 | Castelot et al. | 297/284.1 |
| 4,544,178 | A | 10/1985 | Al-Sheikh et al. | |
| 4,574,409 | A | 3/1986 | McAffrey | |
| 4,596,241 | A | 6/1986 | Neudorfer | |
| 4,842,335 | A * | 6/1989 | Wunderlich | 297/344.21 |

(Continued)

*Primary Examiner*—Anthony D. Barfield
(74) *Attorney, Agent, or Firm*—William W. Cochran; Cochran Freund & Young LLC

(57) ABSTRACT

Disclosed is a method and apparatus for a fully customizable bath chair that is configurable to provide a wide variety of positioning options of the head, trunk and leg support in a sitting or reclining position. The described embodiments can be custom fit to individuals dimensions, or be refit at any time to accommodate growth and/or size changes. Legs, calf support and back angles as well as chair height can be adjusted independently to maximize positioning options to accommodate the support and comfort of the user. The chair has the unique capability to be adjusted in six independent dimensions, each affecting a specific relational fit to the individual users anthropometrics and functional need.

30 Claims, 4 Drawing Sheets

U.S. PATENT DOCUMENTS 4,894,877 A 1/1990 Marsh
4,921,301 A * 5/1990 Haynes ..... 297/118
5,097,542 A 3/1992 Roesler
5,103,509 A 4/1992 Richards
D330,461 S 10/1992 Stevens
5,157,797 A 10/1992 Forwick
5,185,892 A 2/1993 Mitchell
5,226,183 A 7/1993 Clark
5,246,265 A 9/1993 Nagan et al.
5,289,958 A * 3/1994 Jay ..... 224/155
5,335,377 A 8/1994 Masayada et al.
5,341,525 A 8/1994 Tillman et al.
5,377,366 A 1/1995 Boyd et al.
5,393,119 A 2/1995 Mukai
D355,985 S 3/1995 Karten et al.
5,412,817 A 5/1995 Smith
D360,022 S 7/1995 Smith
5,467,486 A 11/1995 Guenther
5,498,054 A 3/1996 Tomlinson
5,517,704 A 5/1996 Dagostino
5,520,435 A 5/1996 Fujimoto et al.
5,535,458 A 7/1996 Siverly
5,682,626 A 11/1997 Banks, Jr. et al.
D389,099 S 1/1998 McKay
5,715,545 A 2/1998 Forwick
5,822,809 A 10/1998 Gallo
5,937,454 A 8/1999 Drew
5,950,259 A * 9/1999 Boggs ..... 297/900
5,953,769 A 9/1999 Williams
5,954,402 A * 9/1999 McInturff ..... 297/440.22
5,988,755 A 11/1999 Fastelli et al.
5,996,139 A 12/1999 Gesse
6,012,769 A 1/2000 Hsueh et al.
D423,240 S * 4/2000 White ..... D6/361
6,088,847 A 7/2000 Burrow
6,094,756 A 8/2000 Carter
6,122,776 A 9/2000 Cheng
6,158,809 A 12/2000 Gobbers et al.
6,164,722 A 12/2000 Mabey
6,199,226 B1 3/2001 Steadman
D439,869 S 4/2001 Kjell et al.
6,279,178 B1 8/2001 Hill
6,334,225 B1 1/2002 Brinkmann
6,351,860 B1 3/2002 Schaffer
6,381,772 B1 5/2002 Dawson
6,397,409 B1 6/2002 Sherlock et al.
6,408,456 B1 6/2002 Fike et al.
2003/0011219 A1 * 1/2003 Chun-Yueh ..... 297/51

* cited by examiner

CUSTOMIZED ARTICULATING ANATOMICAL SUPPORT

BACKGROUND OF THE INVENTION

1. Field of the Invention

The present invention relates to an anatomical support device and more specifically to an anatomical support device in the form of an articulating chair to facilitate bathing of an individual with limited mobility or physical ability that is customized to fit the particular individual and is expandable as the individual grows.

2. Description of the Background

Numerous bathing chairs or seats have been developed to assist persons with limited mobility or physical ability within a bathing enclosure such as a bathtub, shower, whirlpool or the like. These include devices that act as a seat, bench or stool supported by the base or edge of the enclosure. Others include apparatus that are used as a rotatable seat to facilitate transfer of an individual (especially from a wheelchair) to a bathing enclosure. These designs are lacking in many ways, specifically in their inability to adjust to a variety of precise positions to accommodate the support and comfort of the user. These designs additionally lack in their ability to be custom fit and refit to the changing size requirements of a growing individual. Additionally, most bathing chairs do not accommodate the head and trunk support and leg support that certain individuals may require.

SUMMARY OF THE INVENTION

The present invention overcomes the disadvantages and limitations of the prior art by providing a method and system for a fully customizable bath chair that is configurable to provide a wide variety of positioning options of the head, trunk and leg support in a sitting or reclining position and can be custom fit to individuals dimensions, or be refit at any time to accommodate growth and/or size changes. Legs, calf support and back angles as well as chair height can be adjusted independently to maximize positioning options to accommodate the support and comfort of the user. The chair has the unique capability to be adjusted in six independent dimensions, each affecting a specific relational fit to the individual users anthropometrics and functional need.

An embodiment of the present invention may therefore comprise an articulating bathing and support device for an individual comprising: a central support chassis comprising two articulating connector pairs joined by one or more lateral braces that can be variably sized to set the relative position of an anterior articulating connector to a posterior articulating connector within the articulating connector pair, each posterior connector that may be independently rotatably positionable about a coplanar arc of movement, pivoting within the anterior articulating connector, each anterior articulating connector that may be independently rotatably positionable about a coplanar arc of movement, pivoting within the anterior articulating connector; a transverse brace rigidly joining the articulating connector pairs; a positioning stand for the central support chassis comprising an anterior chassis support frame and a posterior chassis support frame, the anterior chassis support frame connected to the anterior articulating connectors, the posterior chassis support frame connected to the posterior articulating connectors; and, a head and thorax support frame connected to the posterior articulating connectors.

An embodiment of the present invention may also comprise an articulating bathing and support chair custom fit to the anthropometric and functional needs of an individual comprising: a central support chassis comprising two pairs of articulating connectors rigidly joined by a transverse brace; each pair of articulating connectors comprising an anterior and a posterior articulating connector rigidly joined by one or more tubular lateral braces; each articulating connector further comprising a superior and an inferior connecting tube, the connecting tube comprising, a semi-cylindrical articulating connecting receiver with a proximal pivot end fixed within the articulating connector and a distal engagement end for receiving a tubular member that articulates in a single plane arc of movement of less than 180 degrees that can be rigidly fixed at more than one point within the arc; the transverse brace mounted between the anterior articulating connectors, perpendicular to a cylindrical axis of the tubular lateral braces and the arc of movement, and rigidly fixes the position of the articulating pairs of articulating connectors with respect to one another; a positioning stand for the central support chassis comprising an anterior chassis support frame connected to the inferior connecting tubes on the anterior articulating connectors and a posterior chassis support frame connected to the connecting tubes of the posterior articulating connectors, the anterior and posterior chassis support frames independently rotatably positionable about the arc of movement of the connecting tube; a lower extremity support frame connected to the superior connecting tubes on the anterior articulating connectors, the lower extremity support frame independently rotatably positionable about the arc of movement of the connecting tubes on the anterior articulating connectors; a head and thorax support frame connected to the superior connecting tubes on the posterior articulating connectors, the head and thorax support frame independently rotatably positionable about the arc of movement of the connecting tubes on the posterior articulating connectors; a drape of support material attached to and extending across the head an thorax support frame, the lower extremity support frame and a superior portion of the lateral braces to support the weight of the individual; the central support chassis being customized to specific dimensions by sizing the lateral braces and the transverse brace of appropriate length and the head and thorax support frame, the lower extremity support frame and the chassis support frames sized to fit the central support chassis and specific dimensional needs of the individual.

An embodiment of the present invention may also comprise a method of customizing an articulating bathing and support device for variations in anthropomology of an individual comprising the steps of: providing a central support chassis comprising two articulating connector pairs; determining a relative distance between an anterior articulating connector to a posterior articulating connector within the central support chassis that is based upon the anthropomology of the individual; rigidly joining the anterior articulating connector to the posterior articulating connector with at least one lateral brace of a length that is based upon the relative distance between the anterior articulating connector to the posterior articulating connector to create a left connector pair and a right connector pair; determining a relative distance between the left connector pair and the right connector pair within the central support chassis that is based upon the anthropomology of the individual; rigidly joining the left connector pair and the right connector pair with at least one transverse brace of a length that is based upon the relative distance between the left connector pair and the right connector pair.

An embodiment of the present invention may also comprise a method of customizing an articulating bathing and support device for variations in anthropomology of an individual comprising the steps of: providing a central support chassis comprising two articulating connector pairs, each joined by at least one lateral brace connecting an anterior articulating connector to a posterior articulating connector within said articulating connector pair to form a left connector pair and a right connector pair, each said posterior connector comprising a superior connecting member and an inferior connecting member pivoting within said anterior articulating connector, each said anterior articulating connector comprising an inferior connecting member pivoting within said anterior articulating connector; fixing the relative distance between said left connector pair and said right connector pair with at least one transverse brace rigidly joining said left connector pair to said right connector pair; dimensioning said central support chassis by: fixing the relative distance between said anterior articulating connector pair and said posterior connecting pair by utilizing at least one said lateral brace of a length that is based upon said anthropomology of said individual; fixing the relative distance between said left connector pair and said right connector pair by utilizing at least one transverse brace of a length that is based upon said anthropomology of said individual.

The disclosed embodiments offer the advantage of performing a wide range of positioning options for the head and thorax support, leg support and independently adjustable legs allowing a greater versatility of users and environments. The full adjustment of supports also allows the chairs to fold easy and flat for convenient storage and transport. Adjustments to the chair are made simple with conveniently located levers that allow the user to raise the height of the chair and make adjustments to the head and thorax portion as well as the lower extremity support. The disclosed embodiments of the chair can be manufactured in a variety of standard sizes using common components and can be custom fit for a particular individual with special needs. A chair can be easily sized by changing the width and length measurements on any or all of the support frames. In addition, the chair support chassis can be readily modified by varying the length of a lateral and/or transverse brace.

DETAILED DESCRIPTION OF THE INVENTION

Figure 1:
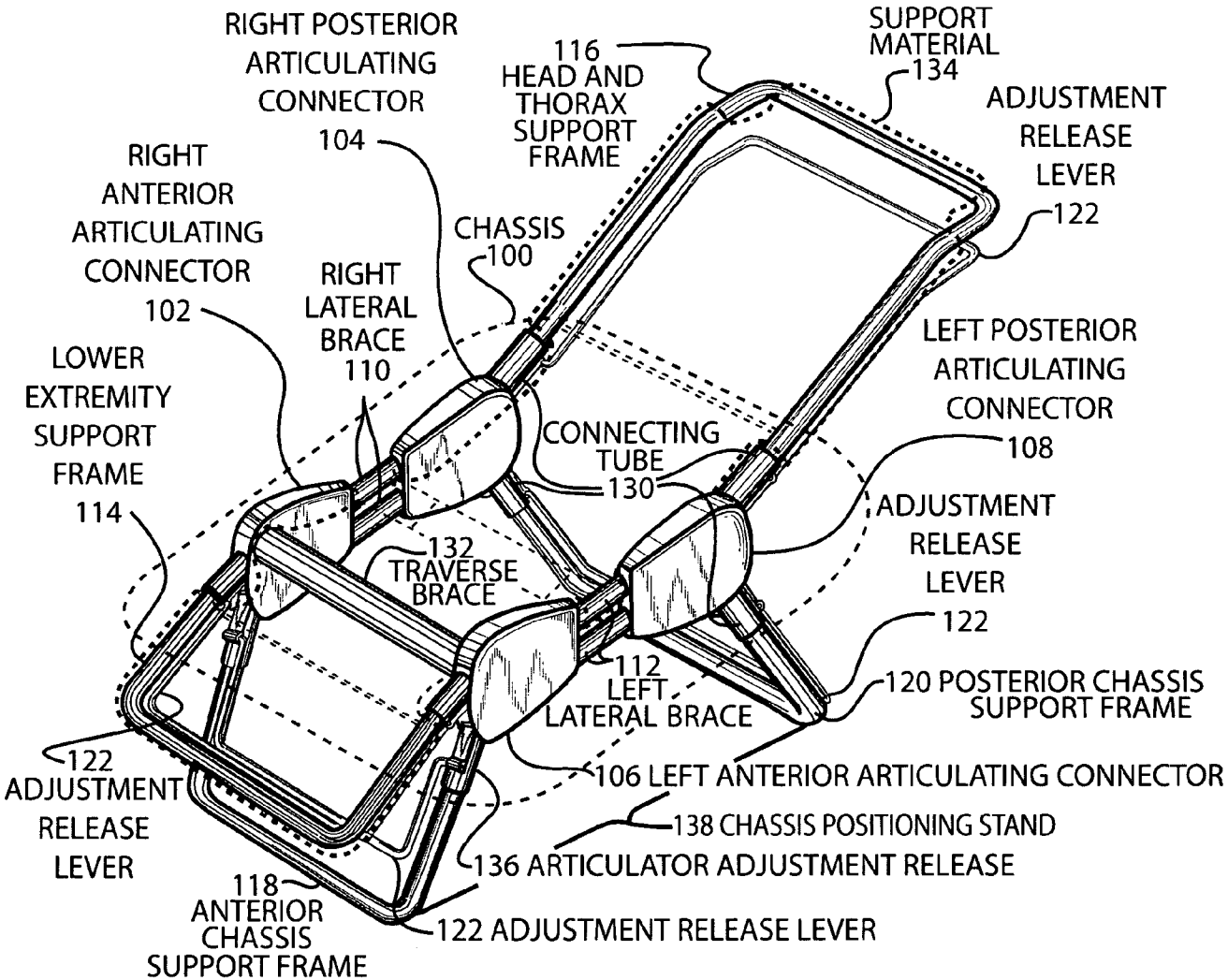
FIG. 1 is a drawing showing an isometric view of a typical embodiment of an articulating bathing and support chair.

While this invention is susceptible to embodiment in many different forms, there is shown in the drawings and will be described herein in detail specific embodiments thereof with the understanding that the present disclosure is to be considered as an exemplification of the principles of the invention and is not to be limited to the specific embodiments described.

FIG. 1 is a drawing showing an isometric view of a typical embodiment of an articulating bathing and support chair. As illustrated in FIG. 1, the central bearing structure of the chair is a chassis 100 which is made up of a set of four articulating connectors 102-108 joined by lateral braces 110 and 112 and a transverse brace 132. Each anterior articulating connector 102 and 106 are attached to a posterior articulating connector 104 and 108 by lateral braces 110 and 112 respectively to create left and right pairs of articulating connectors. These pairs of articulating connectors are joined by a transverse brace 132 mounted perpendicular to the axis of the lateral braces 110 and 112, and rigidly fixes the position of the articulating pairs with respect to one another. This structure forms the chassis 100 of the chair, positions the articulating connecting tubes 130 on opposing sides of the connector pair, and allows all four connecting tubes 130 to move within the same plane.

The transverse brace 132 positions the left pair of articulating connectors 102 and 104 such that the axis of rotation of the left side connecting tubes 130 are approximately parallel to the axis of rotation of the connecting tubes 130 on the left pair of articulating connectors 106 and 108 and displaced by the distance of the transverse brace 132. As can be seen in FIG. 1, the chassis 100 can be sized to a wide variety of dimensions by simply changing the length of the lateral braces 110 and 112 and/or the transverse brace 132. This versatility allows customization of fit during the initial manufacture as well as any time throughout the life of the device.

Two articulating connecting tubes 130 extend from two pivot points within each of the articulating connectors 102-108 to engage four sets of adjustable frame members. These articulating connecting tubes 130 are rotatably mounted, non-ratcheting pivoting connectors, that can be secured at various points throughout an arc of rotation of less than 180 degrees using a lock/release mechanism. A head and thorax support frame 116 connects to the two superior connecting tubes 130 of the posterior articulating connectors 104 and 108 to provide the upper body support section of the chair. A lower extremity support frame 114 connects to the two superior connecting tubes 130 of the anterior articulating connectors 102 and 106 to provide the lower body and leg support section of the chair. The chassis 100 is supported from the ground by a chassis positioning stand 138 made up of an anterior and posterior chassis support 118 and 120. The anterior chassis support 118 connects to the two inferior connecting tubes 130 of the anterior articulating connectors 102 and 106 and the posterior chassis support 120 connects to the two inferior connecting tubes 130 of the posterior articulating connectors 104 and 108.

Each connecting tube 130 is combined with an articulator adjustment release 136 that acts to release the movement of the connecting tube 130 when disengaged allowing articulation through an arc of less than 180 degrees. When the articulator adjustment release 136 is engaged, the connecting tube 130 is held in a fixed position within the arc. The articulator adjustment release 136 mechanisms are accessed in pairs through an adjustment release lever 122 that engages an articulator adjustment release 136 at each end. The adjustment release lever 122 generally follows the shape of the support frame 114-120 to which it is releasing for aesthetics and ease of access by a user.

The rotational position of any one of the four support frames 114-120 can be readily adjusted by gripping the support frame 114-120 and the adjustment release lever 122 at its most distal point from the articulator adjustment release 136 and pulling the adjustment release lever 122 away from the connecting tubes 130 to disengage the articulator adjustment release 136 and position the support frame 114-120. This allows the four support frames to be moved and positioned independently creating a wide range of positioning options. For example, positioning of the lower extremity and head and thorax support frames 114-116 can be made so that the user is positioned in an upright, supine, or recumbent posture. Independent positioning of the anterior and posterior chassis support frames 118-120 allows the seat angle to be adjusted as well as the seat height.

The user of the chair is supported by a support material 134 stretched across the lower extremity support frame 114, the superior portion of the chassis 100 section and the head and thorax support frame 116. This support material 134 can be of any variety of woven or non-woven material, but is typically a synthetic woven mesh material that performs well in a water environment and dries readily.

The disclosed embodiment can be manufactured in a variety of standard sizes using common components and can be custom fit for a particular individual with special needs. A chair can be sized by changing the width and length measurements on any or all of the support frames 114-120. In addition, the chassis 100 can be readily modified by varying the length of the lateral brace 110-112 and the transverse brace 132. In this way, the anthropomology (specific anatomical body measurements including but not limited to size, weight, somatype, girth, physical ability and limitation, and range of motion and the like) of an individual with special needs can be addressed.

Figure 2:
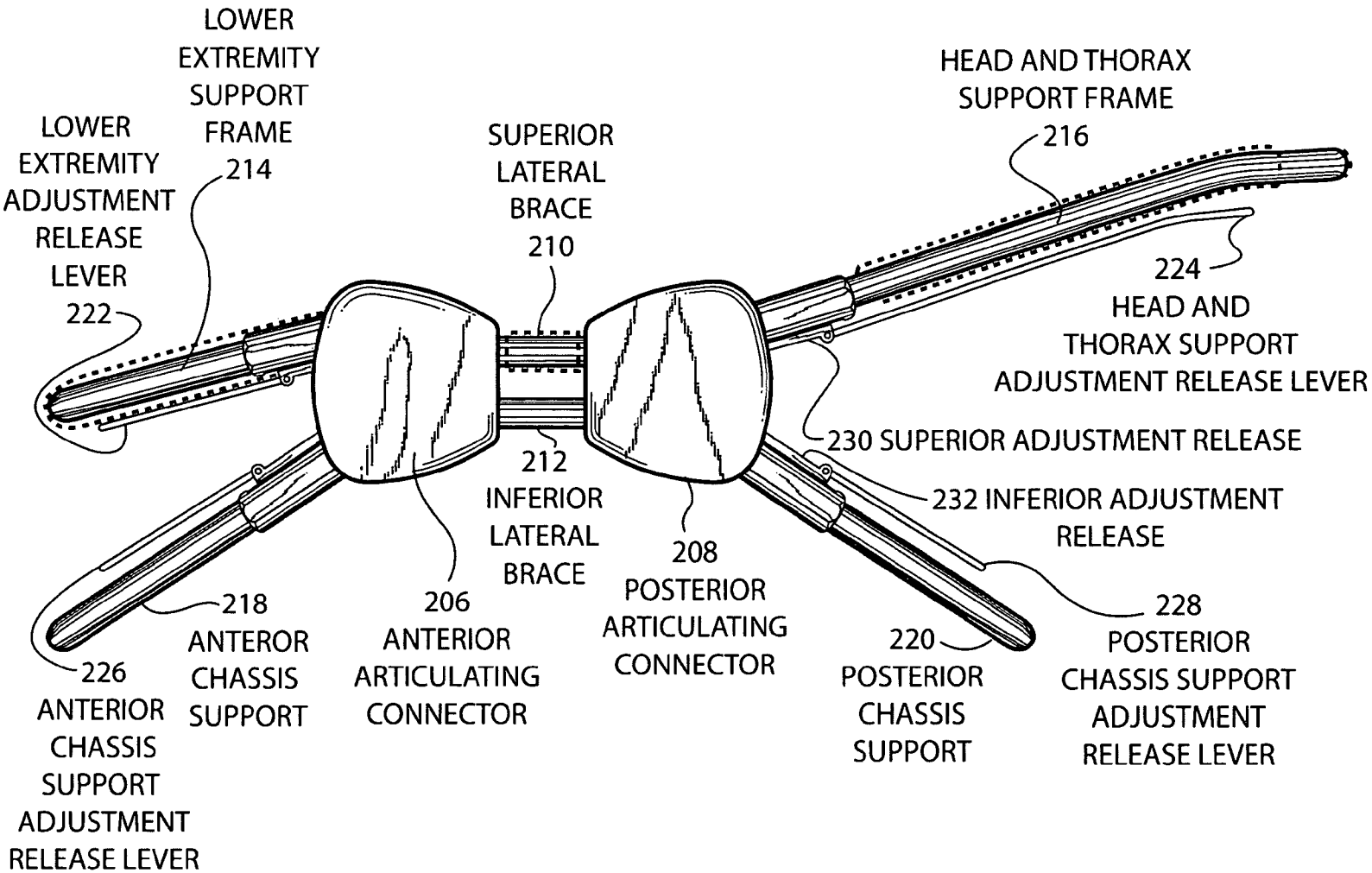
FIG. 2 is a drawing showing a side view of a typical embodiment of an articulating bathing and support chair.

FIG. 2 is a drawing showing a side view of a typical embodiment of an articulating bathing and support chair. This side view further demonstrates the relationship of an articulating connecting pair comprised of an anterior articulating connector 206 connected to a posterior articulating connector 208 by a superior lateral brace 210 an inferior lateral brace 212. As can be readily seen in FIG. 2, anterior articulating connector 206 supports the connection and articulation of the lower extremity support frame 214 and the anterior chassis support 218. Similarly, the posterior articulating connector 208 supports the connection and articulation of the head and thorax support frame 216 and the posterior chassis support 220. Also demonstrated in FIG. 2 are the positional relationships of the adjustment release mechanisms to the articulating connectors. As depicted, the superior adjustments release 230 is connected to, and activated by, the head and thorax support adjustment release lever 224 and follows the shape contour of the head and thorax support frame 216. Similarly, the inferior adjustments release 232 is connected to, and activated by, the posterior chassis support adjustment release lever 228 and follows the shape contour of the posterior chassis support frame 220. An analogous relationship exists on the anterior portion of the chair with the lower extremity adjustment release lever 222 and the anterior chassis support adjustment release lever 226.

Figure 3:
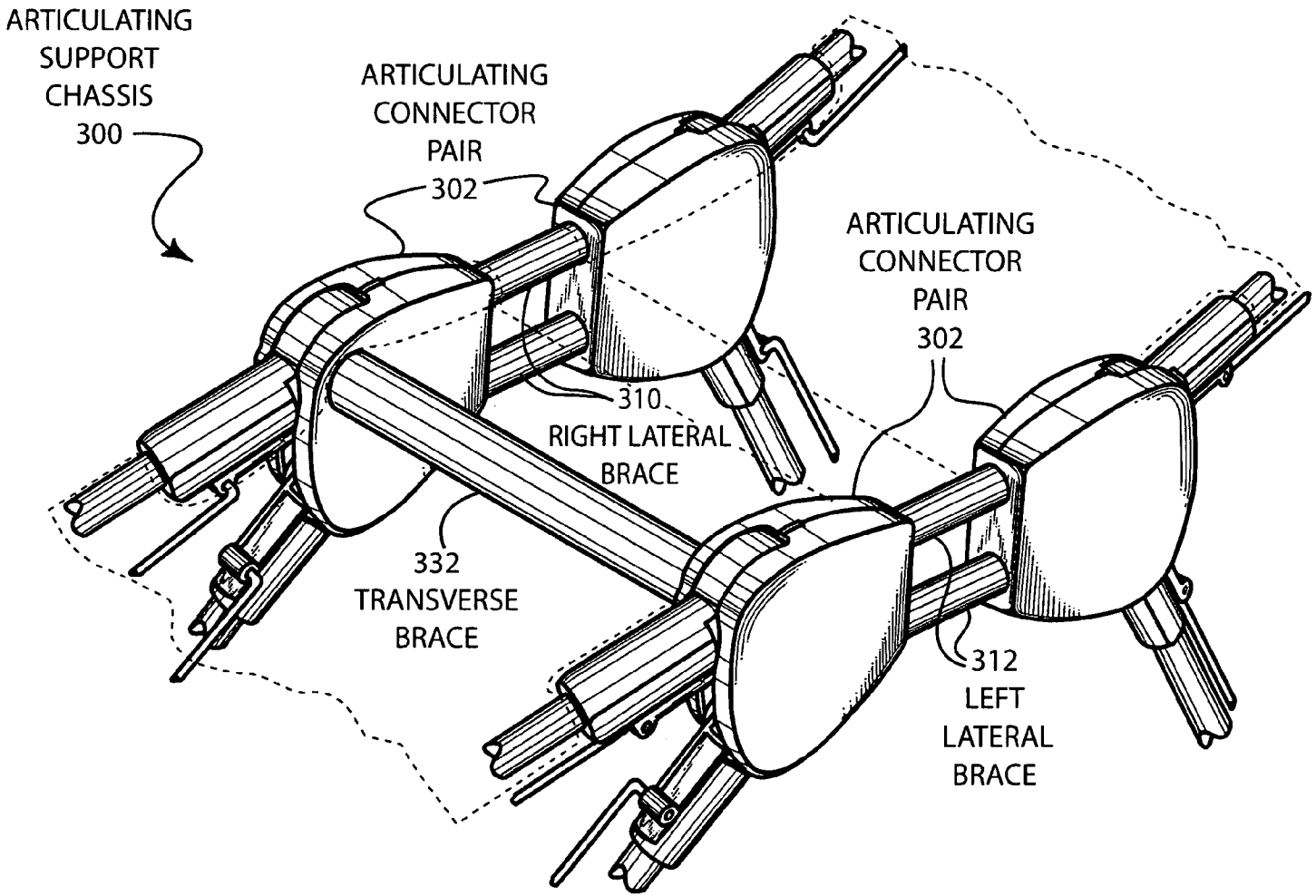
FIG. 3 is a drawing showing a chair chassis comprising two pair of double articulating connectors that is utilized in typical embodiment an articulating bathing and support chair.

FIG. 3 is a drawing showing an articulating support chassis 300 within a typical embodiment an articulating bathing and support chair. This depiction further demonstrates the relationship of two sets of articulating connector pairs 302 whose dimensional spacing is determined by a right and left lateral brace 310 and 312 and the transverse brace 332.

Figure 4:
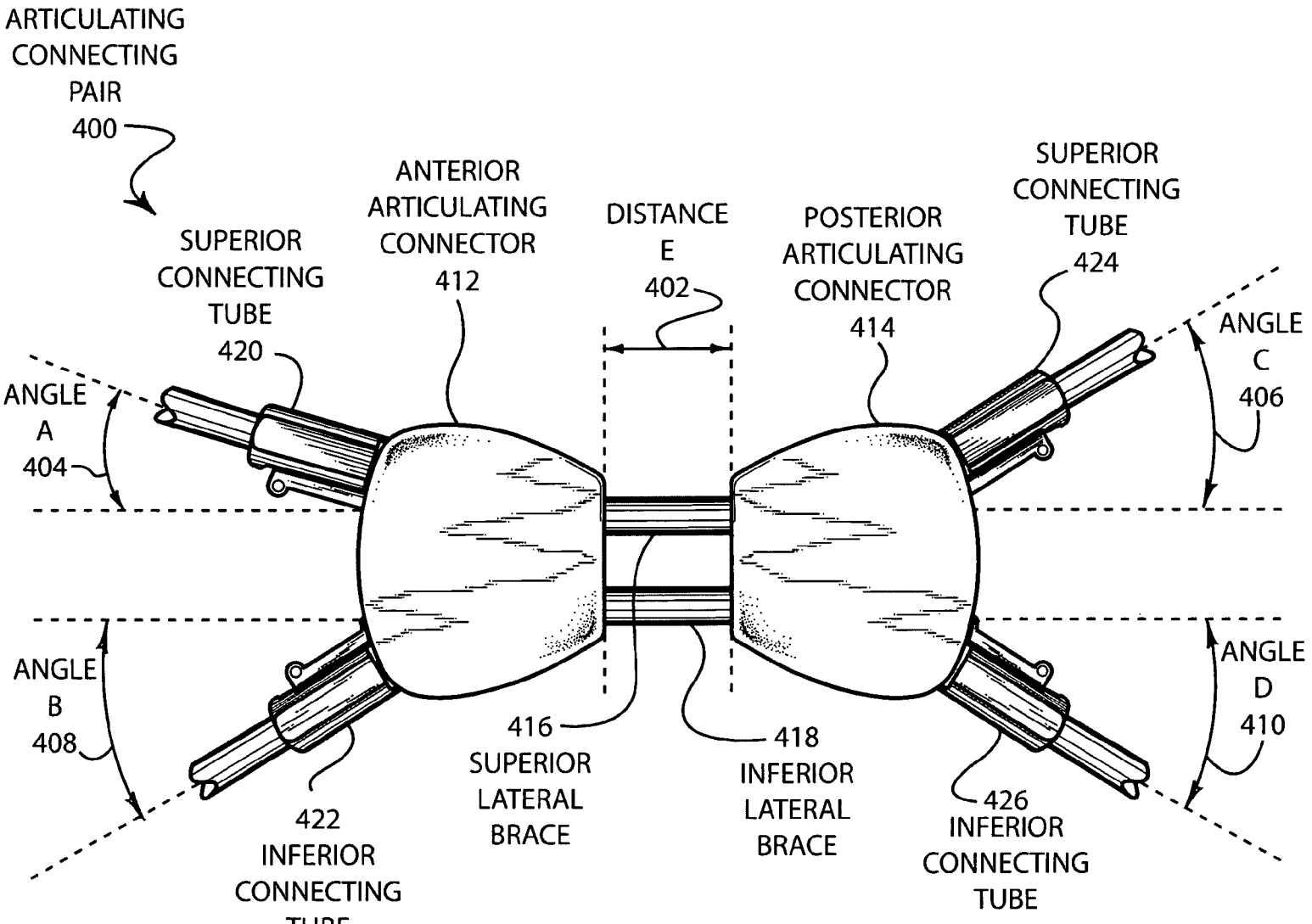
FIG. 4 is a drawing showing the interface between two double articulating connectors within a typical embodiment an articulating bathing and support chair.

FIG. 4 is a drawing showing the interface between two articulating connectors within a typical embodiment an articulating bathing and support chair. As shown in FIG. 4, an articulating connector pair 400 comprises an anterior articulating connector 412 that is rigidly connected to a posterior articulating connector 414 by a superior and an inferior lateral brace 416 and 418 at a distance E 402. This distance E 402 determines the overall chassis length of the chair and can be readily changed by adjusting the lengths of the superior and an inferior lateral braces 416 and 418. The positioning angle of each of the connecting tubes 420-426 can be regulated in an independent manner to achieve a variety of angle combinations for angles A 404, B 406, C 408, and D 410.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. An articulating bathing and support device for an individual comprising:

a central support chassis comprising two articulating connector pairs joined by one or more lateral braces that can be variably sized to set the relative position of an anterior articulating connector to a posterior articulating connector within said articulating connector pair, each said posterior connector having a superior posterior connecting member and an inferior posterior connecting member that may be independently rotatably positionable about a coplanar arc of movement, and pivoting within said anterior articulating connector, each said anterior articulating connector having an anterior connecting member that may be independently rotatably positionable about a coplanar arc of movement, and pivoting within said anterior articulating connector;

a transverse brace rigidly joining said articulating connector pairs;

a positioning stand for said central support chassis comprising an anterior chassis support frame connected to said anterior articulating connectors and a posterior chassis support frame connected to said posterior articulating connector, said anterior and posterior chassis support frames being independently rotatably positionable about said arc of movement of said articulating connector and are rigidly held at more than one point within said arc; and, a head and thorax support frame connected to each said superior posterior connecting member.

2. A device of claim 1 wherein each said anterior articulating connector further comprises an anterior superior connecting member that may be independently rotatably positionable about an arc of movement with said anterior articulating connector, and pivoting within said anterior articulating connector; and, a lower extremity support frame connected to each said superior anterior connecting member.

3. A device of claim 1 further comprising:

a drape of support material attached to and extending across said head and thorax support frame, said lower extremity support frame and a superior portion of said lateral braces to support the weight of said individual.

4. An articulating bathing and support device for an individual comprising:

a central support chassis comprising two articulating connector pairs joined by one or more lateral braces that can be variably sized to set the relative position of an anterior articulating connector to a posterior articulating connector within said articulating connector pair, each said articulating connector comprising a superior connecting member and an inferior connecting member that are independently rotatably positionable about a coplanar arc of movement, pivoting within said anterior articulating connector;

a transverse brace mounted between and rigidly joining said articulating connector pairs;

a positioning stand for said central support chassis comprising an anterior chassis support frame and a posterior chassis support frame, said anterior chassis support frame connected to said inferior connecting members of said anterior articulating connectors, said posterior chassis support frame connected to said inferior connecting members of said posterior articulating connectors, said anterior and posterior chassis support frames being independently rotatably positionable about said arc of movement of said articulating connector and are rigidly held at more than one point within said arc;

a lower extremity support frame connected to said superior connecting members of said anterior articulating connectors;

a head and thorax support frame connected to said superior connecting members of said posterior articulating connectors; and, a drape of support material attached to and extending across said head and thorax support frame, said lower extremity support frame and a superior portion of said lateral braces to support the weight of said individual.

5. A device of claim 4 wherein, said transverse brace is mounted perpendicular to a cylindrical axis of said lateral braces and said arc of movement, and rigidly fixes the position of said articulating pairs of articulating connectors with respect to one another.

6. A device of claim 4 wherein, said head and thorax support frame is connected to both superior connecting tubes on said posterior articulating connectors, and said head and thorax support frame is independently rotatably positionable about said arc of movement of said connecting tubes on said posterior articulating connectors.

7. A device of claim 4 wherein, one or more of said lateral braces, said lower extremity support frame, said head and thorax support frame, and said positioning stand are tubular members.

8. A device of claim 4 wherein, each said articulating connecting member further comprises:

a connecting tube, said connecting tube comprising, a semi-cylindrical articulating connecting receiver with a proximal pivot end fixed within said articulating connector and a distal engagement end for receiving a member that articulates in a single plane arc of movement of less than 180 degrees that can be rigidly held at more than one point within said arc.

9. A device of claim 8 wherein, said anterior chassis support frame is connected to both inferior connecting tubes on said anterior articulating connectors and said posterior chassis support frame is connected to said both inferior connecting tubes of said posterior articulating connectors.

10. A device of claim 8 wherein, said anterior and posterior chassis support frames are independently rotatably positionable about said arc of movement of said connecting tubes.

11. An articulating bathing and support device for an individual comprising:

a central support chassis comprising two articulating connector pairs;

each said articulating connector pair comprising an anterior and a posterior articulating connector, rigidly joined by one or more lateral braces, said lateral braces that can be variably sized to set the relative position of said anterior articulating connector to said posterior articulating connector within said articulating connector pair;

each said articulating connector further comprising a superior and an inferior connecting tube, each said superior and inferior connecting tube comprising, a semi-cylindrical articulating connecting receiver with a proximal pivot end fixed within said articulating connector and a distal engagement end for receiving a member that articulates in a single plane arc of movement of less than 180 degrees that can be rigidly held at more than one point within said arc;

said transverse brace mounted between said anterior articulating connectors, perpendicular to a cylindrical axis of said lateral braces and said arc of movement, and rigidly fixes the position of said articulating pairs of articulating connectors with respect to one another;

a positioning stand for said central support chassis comprising an anterior chassis support frame connected to said inferior connecting tubes on said anterior articulating connectors and a posterior chassis support frame connected to said connecting tubes of said posterior articulating connectors, said anterior and posterior chassis support frames independently rotatably positionable about said arc of movement of said connecting tube and are rigidly held at more than one point within said arc;

a lower extremity support frame connected to said superior connecting tubes on said anterior articulating connectors, said lower extremity support frame independently rotatably positionable about said arc of movement of said connecting tubes on said anterior articulating connectors;

a head and thorax support frame connected to said superior connecting tubes on said posterior articulating connectors, said head and thorax support frame independently rotatably positionable about said arc of movement of said connecting tubes on said posterior articulating connectors; and, a drape of support material attached to and extending across said head an thorax support frame, said lower extremity support frame and a superior portion of said lateral braces to support the weight of said individual.

12. An articulating bathing and support chair custom fit to the anthropometric and functional needs of an individual comprising:

a central support chassis comprising two articulating connector pairs;

each said articulating connector pair comprising an anterior and a posterior articulating connector, rigidly joined by one or more lateral braces, said lateral braces that position of said anterior articulating connector to said posterior articulating connector within said articulating connector pair;

a transverse brace mounted between and rigidly joining said articulating connector pairs;

a positioning stand connected to, and in support of said central support chassis comprising articulating anterior and posterior chassis support frames, said anterior and posterior chassis support frames being independently rotatably positionable about said arc of movement of said articulating connector and are rigidly held at more than one point within said arc;

a lower extremity support connected to said anterior articulating connectors, said lower extremity support independently rotatably positionable about a pivot point within said anterior articulating connectors;

a head and thorax support connected to said posterior articulating connectors, said head and thorax support independently rotatably positionable about a pivot point within said posterior articulating connectors;

said central support chassis being customized to specific dimensions by sizing said lateral braces and said transverse brace of appropriate length and said head and thorax support, said lower extremity support and said chassis support frames sized to fit said central support chassis and specific dimensional needs of said individual.

13. A device of claim 12 wherein, said transverse brace is perpendicular to a cylindrical axis of said lateral braces and said arc of movement, and rigidly fixes the position of said articulating pairs of articulating connectors with respect to one another.

14. A device of claim 12 wherein, said head and thorax support frame is connected to both superior connecting tubes on said posterior articulating connectors, and said head and thorax support frame is independently rotatably positionable about said arc of movement of said connecting tubes on said posterior articulating connectors.

15. A device of claim 12 wherein, one or more of said lateral braces, said lower extremity support frame, said head and thorax support frame, and said positioning stand are tubular members.

16. A device of claim 12 wherein, each said articulating connecting member further comprises:

a connecting tube, said connecting tube comprising, a semi-cylindrical articulating connecting receiver with a proximal pivot end fixed within said articulating connector and a distal engagement end for receiving a member that articulates in a single plane arc of movement of less than 180 degrees that can be rigidly held at more than one point within said arc.

17. A device of claim 16 wherein, said anterior chassis support frame is connected to both inferior connecting tubes on said anterior articulating connectors and said posterior chassis support frame is connected to said both inferior connecting tubes of said posterior articulating connectors.

18. A device of claim 16 wherein, said lower extremity support frame is connected to both superior connecting tubes on said anterior articulating connectors and said lower extremity support frame is independently rotatably positionable about said arc of movement of said connecting tubes on said anterior articulating connectors.

19. An articulating bathing and support chair custom fit to the anthropometric and functional needs of an individual comprising:

a central support chassis comprising two articulating connector pairs;

each said articulating connector pair comprising an anterior and a posterior articulating connector, rigidly joined by one or more lateral braces, said lateral braces that set the relative position of said anterior articulating connector to said posterior articulating connector within said articulating connector pair;

each said articulating connector further comprising a superior and an inferior connecting tube, each said superior and inferior connecting tube comprising, a semi-cylindrical articulating connecting receiver with a proximal pivot end fixed within said articulating connector and a distal engagement end for receiving a member that articulates in a single plane arc of movement of less than 180 degrees that can be rigidly held at more than one point within said arc;

said transverse brace mounted between said anterior articulating connectors, perpendicular to a cylindrical axis of said lateral braces and said arc of movement, and rigidly fixes the position of said articulating pairs of articulating connectors with respect to one another;

a positioning stand for said central support chassis comprising an anterior chassis support frame connected to said inferior connecting tubes on said anterior articulating connectors and a posterior chassis support frame connected to said connecting tubes of said posterior articulating connectors, said anterior and posterior chassis support frames independently rotatably positionable about said arc of movement of said connecting tube and are rigidly held at more than one point within said arc;

a lower extremity support frame connected to said superior connecting tubes on said anterior articulating connectors, said lower extremity support frame independently rotatably positionable about said arc of movement of said connecting tubes on said anterior articulating connectors;

a head and thorax support frame connected to said superior connecting tubes on said posterior articulating connectors, said head and thorax support frame independently rotatably positionable about said arc of movement of said connecting tubes on said posterior articulating connectors;

a drape of support material attached to and extending across said head an thorax support frame, said lower extremity support frame and a superior portion of said lateral braces to support the weight of said individual;

said central support chassis being customized to specific dimensions by sizing said lateral braces and said transverse brace of appropriate length and said head and thorax support frame, said lower extremity support frame and said chassis support frames sized to fit said central support chassis and specific dimensional needs of said individual.

20. An articulating bathing and support device for an individual comprising:

a central support chassis means for forming a frame for said support device comprising two articulating connector pairs, each said articulating connector pair having an anterior and a posterior articulating connector;

a lateral brace means for rigidly joining and determining the relative position of said anterior articulating connector to said posterior articulating connector within said articulating connector pair;

a superior connecting tube means and an inferior connecting tube means on each said articulating connector that pivots at a proximal pivot end, fixed within said articulating connector, and a distal engagement end for receiving a member that articulates in a single plane arc of movement of less than 180 degrees that can be rigidly held at more than one point within said arc;

a transverse brace means mounted between said anterior articulating connectors, perpendicular to a cylindrical axis of said lateral braces and said arc of movement, for rigidly fixing the position of said articulating pairs of articulating connectors with respect to one another;

a positioning stand means to elevate and position said central support chassis means wherein an anterior chassis support frame connected to said inferior connecting tubes on said anterior articulating connectors and a posterior chassis support frame connected to said connecting tubes of said posterior articulating connectors, said anterior and posterior chassis support frames independently rotatably positionable about said arc of movement of said connecting tube and are rigidly held at more than one point within said arc;

a lower extremity support frame means to elevate and position the lower extremities of said individual, said lower extremity support frame means connected to said superior connecting tubes on said anterior articulating connectors, said lower extremity support frame means independently rotatably positionable about said arc of movement of said connecting tubes on said anterior articulating connectors;

a head and thorax support frame means to elevate and position the head and thorax of said individual, said lower head and thorax frame means connected to said superior connecting tubes on said posterior articulating connectors, said head and thorax support frame means independently rotatably positionable about said arc of movement of said connecting tubes on said posterior articulating connectors; and, a drape material supporting means attached to and extending across said head and thorax support frame, said lower extremity support frame and a superior portion of said lateral braces for supporting the weight of said individual.

21. An articulating bathing and support device of claim 20 further comprising:

said central support chassis means that is customized to specific dimensions by sizing said lateral brace means and said transverse brace means of appropriate length and said head and thorax support frame means, said lower extremity support frame means and said chassis support frames means sized to fit said central support chassis means for achieving specific dimensional needs of said individual.

22. A method of customizing an articulating bathing and support device for variations in anthropomology of an individual comprising the steps of:

providing a central support chassis comprising two articulating connector pairs;

determining a relative distance between an anterior articulating connector to a posterior articulating connector within said central support chassis that is based upon said anthropomology of said individual;

rigidly joining said anterior articulating connector to said posterior articulating connector with at least one lateral brace of a length that is based upon said relative distance between said anterior articulating connector to said posterior articulating connector to create a left connector pair and a right connector pair;

determining a relative distance between said left connector pair and said right connector pair within said central support chassis that is based upon said anthropomology of said individual; and, rigidly joining said left connector pair and said right connector pair with at least one transverse brace mounted between and rigidly joining said articulating connector pairs of a length that is based upon said relative distance between said left connector pair and said right connector pair;

providing a positioning stand for said central support chassis comprising an anterior chassis support frame and a posterior chassis support frame, said anterior chassis support frame connected to anterior articulating connectors, said posterior chassis support frame connected to said posterior articulating connectors, said anterior and posterior chassis support frames being independently rotatably positionable about said arc of movement of said articulating connector and are rigidly held at more than one point within said arc.

23. A method of claim 22 further comprising the step of:

providing a head and thorax support frame connected to said posterior articulating connectors.

24. A method of claim 22 further comprising the step of:

providing a lower extremity support frame connected to said anterior articulating connectors.

25. A method of customizing an articulating bathing and support device for variations in anthropomology of an individual comprising the steps of:

providing a central support chassis comprising two articulating connector pairs, each joined by at least one lateral brace connecting an anterior articulating connector to a posterior articulating connector within said articulating connector pair to form a left connector pair and a right connector pair, each said posterior connector comprising a superior connecting member and an inferior connecting member pivoting within said anterior articulating connector, each said anterior articulating connector comprising an inferior connecting member pivoting within said anterior articulating connector;

fixing the relative distance between said left connector pair and said right connector pair with at least one transverse brace rigidly joining said left connector pair to said right connector pair;

dimensioning said central support chassis by:

fixing the relative distance between said anterior articulating connector pair and said posterior connecting pair by utilizing at least one said lateral brace of a length that is based upon said anthropomology of said individual;

fixing the relative distance between said left connector pair and said right connector pair by utilizing at least one transverse brace rigidly joining said articulating connector pairs of a length that is based upon said anthropomology of said individual; and, providing a positioning stand for said central support chassis comprising an anterior chassis support frame connected to said anterior articulating connectors and a posterior chassis support frame connected to said posterior articulating connectors, said anterior and posterior chassis support frames being independently rotatably positionable about said arc of movement of said articulating connector and are rigidly held at more than one point within said arc;

dimensioning said posterior chassis support frame and said anterior chassis support frame based upon said anthropomology of said individual;

providing a head and thorax support frame connected to said superior connecting members of said posterior articulating connectors;

dimensioning said head and thorax support based upon said anthropomology of said individual.

26. A method of reconfiguring the structural components of a customized articulating bathing and support device for changes in anthropomology of an individual comprising the steps of:

providing a central support chassis comprising two articulating connector pairs, each said articulating connector pair comprising an anterior articulating connector rigidly joined to a posterior articulating connector to create a left connector pair and a right connector pair, said left connector pair rigidly joined to and said right connector pair with at least one transverse brace;

providing a positioning stand for said central support chassis comprising an anterior chassis support frame connected to said anterior articulating connectors and a posterior chassis support frame connected to said posterior articulating connectors, said anterior and posterior chassis support frames being independently rotatably positionable about said arc of movement of said articulating connector and are rigidly held at more than one point within said arc;

reconfiguring a central support chassis by:

evaluating the relative distance between said anterior articulating connector pair and said posterior connecting pair based upon said changes in anthropomology of said individual;

replacing at least one said lateral brace as necessary, based upon said changes in anthropomology of said individual;

evaluating the relative distance between said left connector pair and said right connector pair based upon said changes in anthropomology of said individual; and, replacing at least one said transverse brace mounted between and rigidly joining said articulating connector pairs as necessary, based upon said changes in anthropomology of said individual.

27. A method of claim 26 further comprising the step of:

providing a head and thorax support frame connected to said posterior articulating connectors.

28. A method of claim 26 further comprising the step of:

providing a lower extremity support frame connected to said anterior articulating connectors.

29. A method of reconfiguring the structural components of a customized articulating bathing and support device for changes in anthropomology of an individual comprising the steps of:

providing a central support chassis comprising two articulating connector pairs, each joined by at least one lateral brace connecting an anterior articulating connector to a posterior articulating connector within said articulating connector pair to form a left connector pair and a right connector pair, each said posterior connector comprising a superior connecting member and an inferior connecting member pivoting within said anterior articulating connector, each said anterior articulating connector comprising an inferior connecting member pivoting within said anterior articulating connector;

fixing the relative distance between said left connector pair and said right connector pair with at least one transverse brace rigidly joining said left connector pair to said right connector pair;

reconfiguring said central support chassis by:

evaluating the relative distance between said anterior articulating connector pair and said posterior connecting pair based upon said changes in anthropomology of said individual;

replacing at least one said lateral brace as necessary, based upon said changes in anthropomology of said individual;

evaluating the relative distance between said left connector pair and said right connector pair based upon said changes in anthropomology of said individual;

replacing at least one said transverse brace as necessary, based upon said changes in anthropomology of said individual;

providing a positioning stand for said central support chassis comprising an anterior chassis support frame connected to said anterior articulating connectors and a posterior chassis support frame connected to said posterior articulating connectors, said anterior and posterior chassis support frames being independently rotatably positionable about said arc of movement of said articulating connectors and are rigidly held at more than one point within said arc;

evaluating the dimensions of said posterior chassis support frame and said anterior chassis support frame based upon said changes in anthropomology of said individual;

replacing said posterior chassis support frame and said anterior chassis support frame as necessary, based upon said changes in anthropomology of said individual;

providing a head and thorax support frame connected to said superior connecting members of said posterior articulating connectors;

evaluating the dimensions of said head and thorax support based upon said changes in anthropomology of said individual; and, replacing said head and thorax support as necessary, based upon said changes in anthropomology of said individual.

30. An articulating bathing and support device for an individual comprising:

a central support chassis comprising two connector pairs joined by one or more lateral braces that can be variably sized to set the relative position of an anterior connector to a posterior articulating connector within said connector pair, each said posterior connector having a superior posterior connecting member and an inferior posterior connecting member that may be independently rotatably positionable about an arc of movement, and pivoting within said anterior articulating connector, a transverse brace mounted between and rigidly joining said articulating connector pairs;

a positioning stand for said central support chassis comprising an anterior chassis support frame and a posterior chassis support frame, said anterior chassis support frame connected to each said inferior posterior connecting member, said posterior chassis support frame connected to said inferior posterior connecting member, said anterior and posterior chassis support frames being independently rotatably positionable about said arc of movement of said articulating connectors and are rigidly held at more than one point within said arc; and, a head and thorax support frame connected to each said superior posterior connecting member.

* * * * *